United States Patent [19]

Wallther

[11] Patent Number: 4,509,711

[45] Date of Patent: Apr. 9, 1985

[54] DEVICE FOR DETACHABLY SUPPORTING A WORK STAND ON A WALL SURFACE OR THE LIKE

[75] Inventor: Harry Wallther, Hindås, Sweden

[73] Assignee: Stallningsgruppen i Goteborg Aktiebolag, Goteborg, Sweden

[21] Appl. No.: 375,280

[22] PCT Filed: Sep. 10, 1981

[86] PCT No.: PCT/SE81/00253

§ 371 Date: Apr. 27, 1982

§ 102(e) Date: Apr. 27, 1982

[87] PCT Pub. No.: WO82/01026

PCT Pub. Date: Apr. 1, 1982

[30] Foreign Application Priority Data

Sep. 11, 1980 [SE] Sweden ..... 8006368

[51] Int. Cl.[3] ..... A47G 29/02

[52] U.S. Cl. ..... 248/235; 182/82

[58] Field of Search ..... 248/235, 239, 240, 242; 182/82

[56] References Cited

U.S. PATENT DOCUMENTS

| | | | |
|---|---|---|---|
| 1,457,066 | 5/1923 | Kestner | 248/235 |
| 2,483,758 | 10/1949 | Douglas | 248/242 |
| 3,270,997 | 9/1966 | Gethmann | 248/235 |
| 4,021,011 | 5/1977 | Karlsson et al. | 248/235 |

FOREIGN PATENT DOCUMENTS

| | | |
|---|---|---|
| 0127935 | 9/1973 | Norway . |
| 0361854 | 11/1973 | Sweden . |

*Primary Examiner*—William H. Schultz
*Assistant Examiner*—Ramon O. Ramirez

[57] ABSTRACT

A device for detachably supporting a work stand to a wall surface (2) for example. This includes a supporting member (4) which originates from the securing surface and which can be hooked up, by means of a coupling device (3) fitted to the supporting member, in a holder element (1) fixed to the wall surface. This is formed like a plate-shaped body which comprises at least one supporting surface adapted to be fixed to the wall surface (2) and two hooking-up portions which are directed away from one another and each of which has its own bearing surface facing the wall surface (2). The coupling device (3) comprises two portions (11) which are provided with guide surfaces facing one another. Between them these form a gap adapted to receive the holder element. Situated in the gap are locked members (16, 22) which are each hooked up by their own hooking-up portions. A device (21) is able to be changed over between a locking position and a releasing position. In the locking position assurance is provided that the coupling device is held in the firmly hooked state and in the releasing position, the coupling device can be unhooked from the holder element (1).

5 Claims, 7 Drawing Figures

DEVICE FOR DETACHABLY SUPPORTING A WORK STAND ON A WALL SURFACE OR THE LIKE

TECHNICAL FIELD

The present invention relates to a device for detachably supporting a work stand or the like to a wall surface or the like, which includes a supporting member originating from the securing surface which supporting member is adapted to be hooked, by means of a coupling device fitted to the supporting member, in a holder element fixed to the securing surface and to be supported against the wall surface of means of a lower supporting surface below the coupling device.

The present invention relates to those scaffolds which are adapted to be hooked to holder elements which are fixed to a wall surface, the hull of a vessel or the like. The holder element is usually welded to the wall surface at a plurality of points at predetermined distances apart and levels, after which brackets are suspended and used to carry working platforms and the like. This type of scaffolding occurs inter alia in the shipbuilding industry where the hull of a vessel forms firm surfaces of weldable material. This type of work stand thus does not require any support at the base which is an advantage as a result of the fact that the work stand thus does not need to be built up over the whole height up to the actual work places.

BACKGROUND ART

A work stand of the kind indicated above is known through the Swedish specification No. 361 854 as laid open. In the known device, the holder element has the form of a T-section. With this device, the web of the T-section is exposed, in practice, to very heavy flexural stresses as a result of unforseen breaks and displacements in the work stand. These stresses have proved so great that in several cases the holder member has given way with serious accidents as a result. As a result of the demand for high bending strength and toughness in combination with a complicated shape in this connection, the holder element becomes very expensive to manufacture. Since these holder elements are usually intended for use once only, there is a strong requirement to produce the elements at relatively low costs.

THE TECHNICAL PROBLEM

The object of the present invention is to develop a device according to the present invention with which a stable and secure holding of the brackets is obtained while at the same time the holder elements can be produced at a low cost.

THE SOLUTION

Said object is achieved by means of a device according to the present invention which is characterised in that the holder element is made like a plate-shaped body which comprises at least one supporting surface adapted to be secured to the securing surface, and at least two hooking-up portions which are directed away from one another and each of which has its bearing surface at least partially turned towards the securing surface, and that the coupling device comprises, on the one hand two portions which are provided with guide surfaces facing one another which between them form a gap adapted to receive the holder element, and on the other hand two locking members which are situated in the gap and which are adapted to be hooked up each by its own hooking portion and on the other hand a device which can be changed over between a locking position and a releasing position and which, in the locking position, ensures that the coupling device is held in the firmly hooked state and which, in the releasing position, enables the coupling device to be unhooked from the holder element, and that the coupling device comprises at least one upper supporting surface by means of which the coupling device is adapted to bear against said wall surface in the connected state of the device.

DESCRIPTION OF THE FIGURES

The invention will be described in more detail below with an example of embodiment with reference to the accompanying drawings in which.

PREFERRED FORMS OF EMBODIMENT

Figure 1:
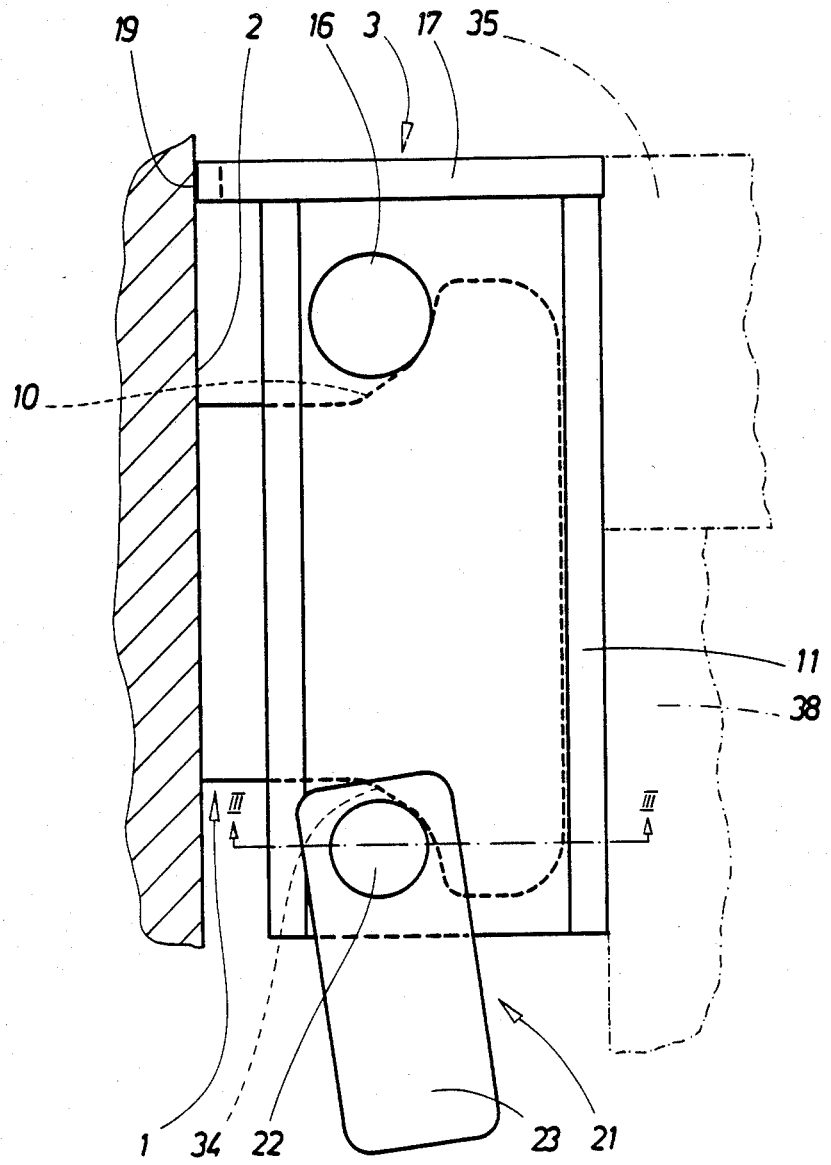
FIG. 1 shows a side view of a device according to the invention, mounted on a wall surface.
Figure 2:
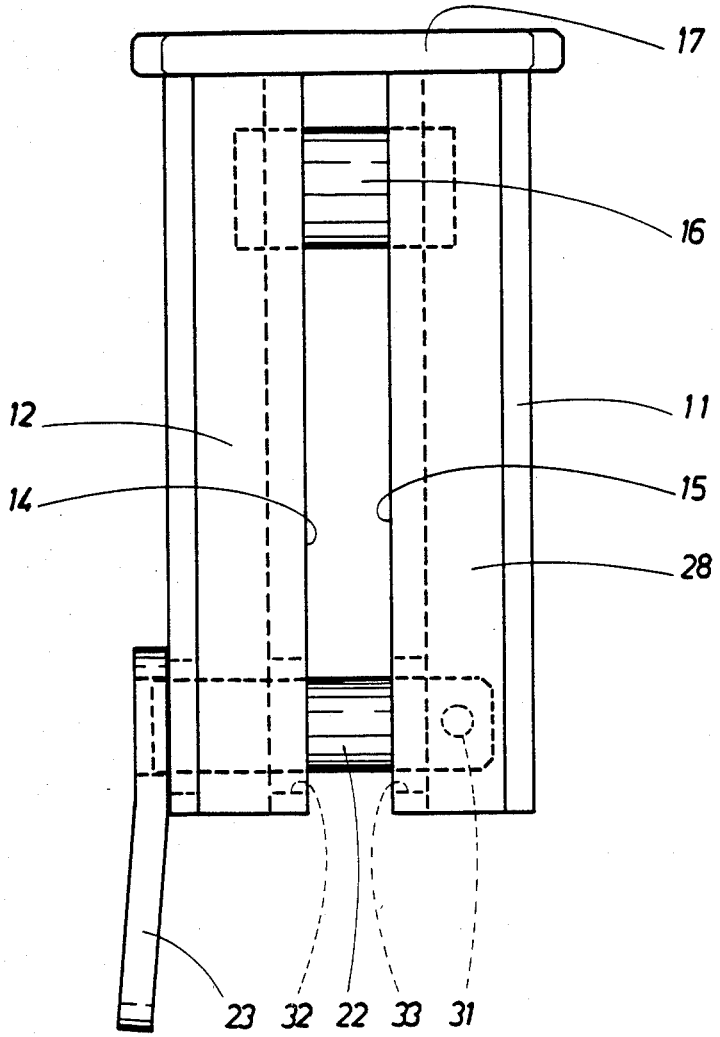
FIG. 2 shows a view from the back of only one coupling device included in the device according to the invention.
Figure 3:
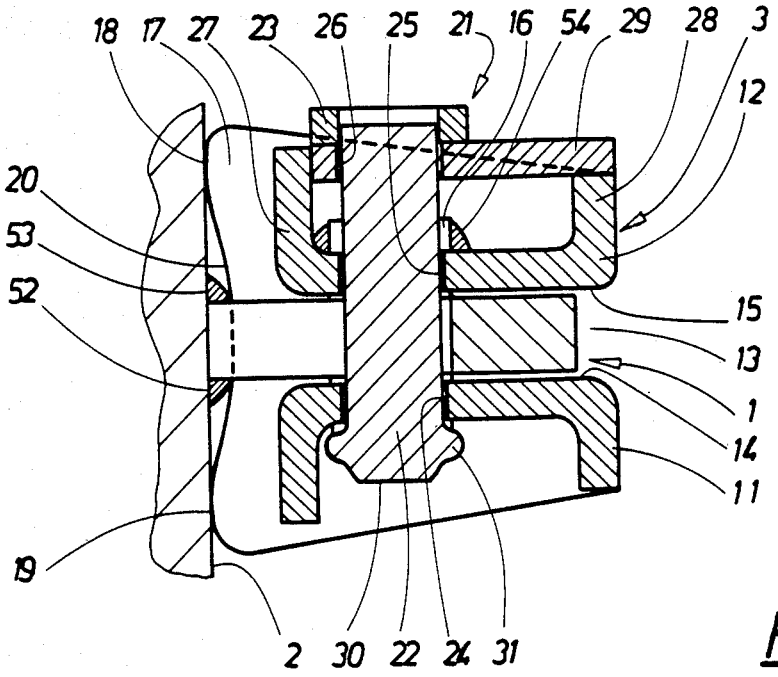
FIG. 3 shows a section through the device of FIG. 1 on the line III—III.
Figure 4:
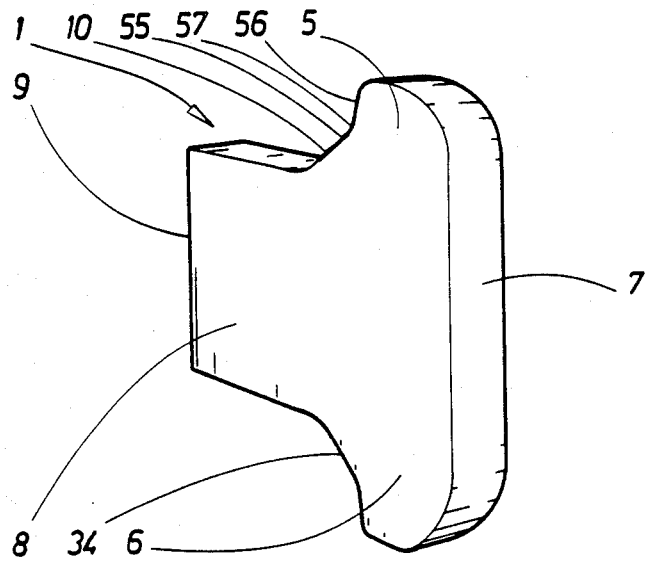
FIG. 4 is a perspective view of a holder element included in the device.

As can be seen from FIGS. 1–4, the device according to the invention comprises a holder element 1 which is fixed to a wall surface 2, for example, the hull of a vessel, and a coupling device 3 which is adapted to be hooked up to the holder element 1. As indicated in FIG. 1 and as can best be seen from FIG. 5, the coupling device 3, in the example shown, is fixed to the inner end of a bracket 4 to carry a work stand, not shown. The work stand may consist of working platforms which extend between a plurality of brackets situated at the same level. The brackets may be situated at a plurality of levels in connection with the work places which are to made accessible to personnel, who stand on the working platforms. Again with reference to FIGS. 1–4, it can be seen that the holder element 1 in the example shown is symmetrical about a horizontal center line and comprises both at the top and at the bottom a hook-shaped portion 5, 6. Furthermore, the holder element 1 is made in the form of a single plate-shaped body with a head portion 7 formed by one of the hook-shaped portions 5, 6 and a neck portion 8 which becomes narrower from the head portion. The neck portion 8 is terminated by a preferably plane securing surface 9. As can be seen from FIGS. 1 and 3, the holder member 1 is adapted to be secured, by its securing surface 9, to the wall surface 2, for example by means of welding if the wall surface is made of a weldable material such as steel. The holder element 1 further comprises two bearing or stop surfaces 10, 34 which are at least partially turned inwards towards the wall surface 2 in the mounted state of the element.

In the example shown, the coupling device 3 is constructed in the form of two elongated elements 11, 12 which extend along one another and which are made in the form of U-sections facing away from one another. These are situated spaced apart so that a slot-shaped gap 13 is formed between them, the width of which is of the same order of magnitude and in practice somewhat exceeds the thickness of the plate-shaped holder element 1. At the sides, the gap 13 is bounded by two opposite guide surfaces 14, 15 each of which is situated at its own side of the elements 11, 12. Extending transversely through the gap 13 between the elongated elements 11, 12 are two locking members 16, 22 which, in the example shown, are constructed in the form of bars 24, 25 extending through bores in the two elements 11, 12. A supporting plate 17 is fixed by means of welding or the like to the upper ends of the two elements 11, 12. The shape of the supporting plate, which forms a protective covering member, can best be seen from the section in FIG. 3. From this it can be seen that the supporting plate 17 comprises, at one edge, two supporting surfaces 18, 19 which are situated spaced apart and which comprise between them an inwardly curved portion 20. These two supporting surfaces 18, 19 are adapted to bear against the actual wall surface 2 in the connected state of the device. This bearing is ensured by the oblique bearing surface 10 of the holder element 1, on which the hookable member 16 rests. The coupling device 3 is pressed against the wall surface 2 by the weight of the device.

The lower locking member 22 is included in a releasable locking device 21. In the example shown, the lower locking member 22 consists of a pin which is provided with a handle 23. The pin extends through the bores 24, 25 in each of the two elongated elements 11, 12 and through a third bore 26 in a guide plate 29 extending between the two webs 27, 28 of the element 12. As can be seen from FIGS. 2 and 3, the pin 22 comprises, at its one end 30, two projections 31 while the two bores 24, 25 in the elements 11, 12 comprise corresponding recesses 32, 33 which are adapted to permit withdrawal of the pin 22 in a certain angular position, but to prevent withdrawal in a locking position. In the Figures, the locking device 21 is shown in the locking position with the handle 23 directed downwards. As a result of the asymmetrical positioning of the handle 23 on the pin, the handle tends to assume this position by its weight. In order to release the locking device 21, the handle is thus turned through about a quarter of a turn, whereupon the projections 31 are brought into position opposite the recesses 32, 33, after which the pin 22 can be withdrawn. In its locking position, the locking device 21 is in such a position opposite the lower hook-shaped portion 6 of the holder member 1 that the locking is brought about by the cooperation of the pin 22 with the oblique stop surface 34.

Figure 5:
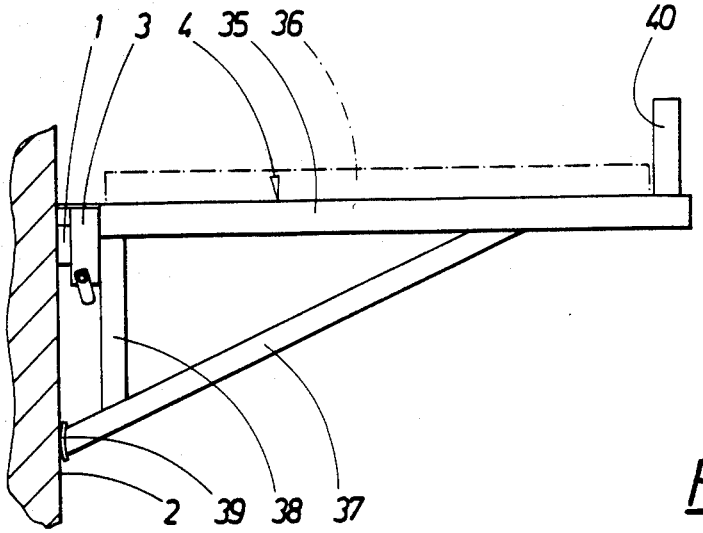
FIG. 5 shows, on a smaller scale, a complete device according to the invention in a first example of embodiment.
Figure 6:
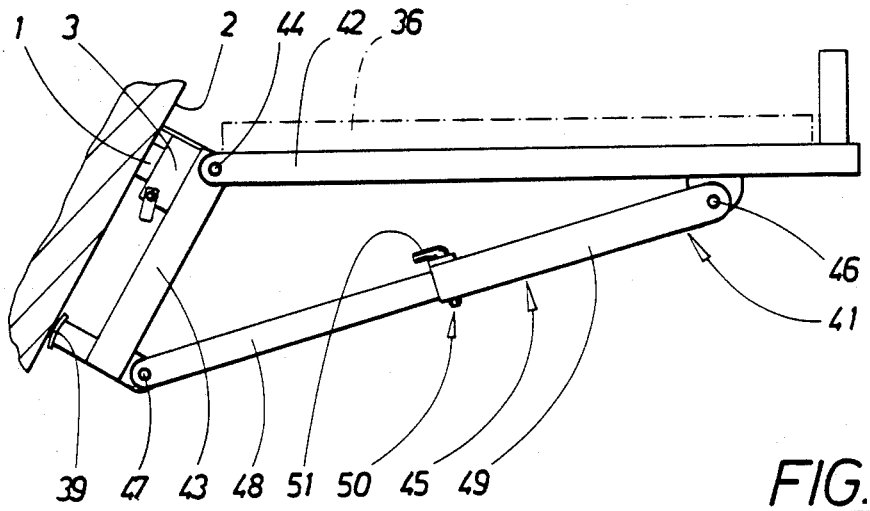
FIG. 6 shows the device according to the invention in a second example of embodiment and FIG. 7 shows an advantageous alternative embodiment of the holder element.

As indicated above with reference to FIG. 5, the coupling device 3 in the example shown is fixed to one end of a bracket 4. In the example shown, this is constructed in the form of a substantially horizontal arm 35 which is adapted to support the working platforms 36 one of which is indicated in FIGS. 5 and 6 in chain line. The bracket 4 further comprises, at its outer end, a stop element 40 in the form of a section standing upright. It is adapted to form a stop for the working platforms against displacement sideways outside the supporting arm 35. In practice, the working platforms 36, which form elongated elements, are fixed in a suitable manner to the associated brackets 4. The bracket 4 further comprises an oblique strut 37 which is fixed to the arm 35 at a distance from the coupling device 3 and is connected to the coupling device and the arm 35 at its inner end by means of a vertical stay 38. The strut 37 comprises, at its lower end a supporting element 39 which forms a lower supporting surface for the device which is situated spaced apart from the coupling device 3 and the above-mentioned upper supporting surfaces 18, 19 of the device. The device is adapted to be supported against the wall surface 2 by means of the lower supporting surface 39 and, together with the hooking of the coupling device 3 to the holder element 1, to form a stable suspension for the bracket 4.

Thus a complete work stand usually consists of at least two brackets 4, which are situated at the same level and spaced apart from one another and are mounted on the same wall surface 2 as a result of the fact that holder elements 1 are mounted on the wall surface at the same level and a predetermined distance apart. The working platforms 36 may appropriately rest on the supporting arms 35 of the brackets as a result of the fact that the ends of the platforms are each fixed to its own supporting arm 35 of the bracket 4. With more than two platforms one after the other at the same level, the platforms meet one another lengthwise with the ends adjacent to one another resting on the same bracket. The working platforms may consist of elongated floor gratings in which case, with longer units, apart from a bracket at each end, intermediate brackets are also required. The platforms may also consist of conventional scaffold planks which, for safety reasons preferably require some form of device for holding the ends of the planks to the associated brackets 4.

The bracket 4 of standard type shown in FIG. 5 is intended for the type of wall surface 2 which occurs most commonly and which is vertical or substantially vertical. The bracket is shown in another form of embodiment in FIG. 6 and is here designated by 41. The bracket 41 is adjustable to different inclinations of the wall surface 2 which is an advantage, for example with the hull of a vessel. This is possible as a result of the fact that the supporting arm, here designated by 42, is pivotally mounted on the vertical stay 43 in an upper articulation 44 while the oblique strut 45 is pivotally mounted, at its upper end, in the supporting arm 42 in an outer articulation 46 and is pivotally mounted, at its lower end, in the lower end of the stay 43 in a lower articulation 47. Furthermore, the strut 45 is adjustable to different lengths as a result of the fact that it is divided into two elements 48, 49 which can be locked to one another in different positions of adjustment by means of a locking device 50. This consists, for example, of a pin 51 which extends through two bores situated opposite one another in one end of the element 49 and can be taken through two of a pluralty of pairs of bores situated opposite one another in the element 48 and so render possible an adjustment of the supporting arm 42 of the bracket 41 and hence of the working platforms 36 in a substantially horizontal position regardless of the inclination of the wall surfaces 2 within certain limits. The construction of the holder element 1 and of the coupling device 3 can nevertheless be the same as in the embodiment shown in FIG. 5.

The whole device according to the invention with holding elements, 1, coupling devices 3 and brackets 4 is made of a strong material, for example steel, while the working platforms 36 can be made of a lighter material, for example light metal or wood. As a result of the plate-like shape of the holder element 1, this can be produced by cutting out or stamping out of standard material and so be given great strength in combination with a low production cost. The erection of a complete scaffold is thus prepared by securing a plurality of holder elements 1 to predetermined points on the wall surface 2 by appropriate welding. In the course of this, the holder element 1 is laid with its plane supporting surface 9 against the wall surface, after which a welding seam 52, 53 is applied to each side of the supporting surface 9, preferably over its whole height or in the form of two or more shorter strands. In the course of this, the holder element 1 must be positioned with its main plane vertical. Some degrees of deviation from this are tolerated without unfavourable loading occurring. The fact that the supporting surface 9 does not bear entirely against the wall surface 2 at the top or bottom does not detract in any way from the strength of the device. As a result of the symmetry of the holder element 1, it is immaterial which end of the holder element faces upwards.

After the holder elements 1 have been secured, the brackets 4 are suspended, the locking device 21 being held in the releasing position, that is to say the pin 22 is withdrawn through the bores 24, 25. As a result of the fact that the bore 26 lacks a recess for the projection 31, complete withdrawal of the pin 22 is prevented which thus comes into a stop position with the projection 31 inside the plate 29. The portion shown behind the pin 22 in FIG. 3, outside the element 12, constitutes a portion of the bar 16 which is fixed to the element 12 by a welding seam 54. Thus, in the releasing position of the locking device 21, the brackets 4 can be suspended on the holder element by means of the coupling device 3 which is conveyed with the locking member 16 over the hook-shaped portion 5, the holder element being introduced with its plate-shaped body into the gap 13 between the elongated elements 11, 12. When the locking member 16 is laid against the oblique bearing surface 10, the coupling device 3 is caused to bear, by the weight of the bracket, against the wall surface 2 with its two supporting surfaces 18, 19. The supporting element 39 is also applied against the wall surface 2 by the weight of the brackets.

After that the lower locking member 22 is brought into position as a result of the fact that the pin 22 is introduced into the locking position with the handle 23 turned angularly so that the projections 31 can pass through the bores 24, 25, after which the locking device is changed over, by turning the pin through about a quarter of a turn, into the locking position with the handle directed substantially downwards. The bores 24-26 are so placed that there is a little clearance between the pin 22 and the stop surface 34, on the one hand to facilitate the introduction and withdrawal of the pin and on the other hand in view of reasonable manufacturing tolerances.

As a result of the construction of the device according to the invention, the brackets 4 have a stable and firm suspension wherein the brackets 4 and the loading acting on these from the working platforms and their load is transmitted to the wall surface 2 via the two elements 11, 12 of the coupling device 3, the two locking members 16, 22 to the holder element 1 via the bearing or stop surfaces 10, 34. These extend substantially transversely to the main plane of the holder element and as a result of their comparatively great width form a satisfactory guide for the brackets together with the two supporting surfaces 18, 19 situated spaced apart and the two guide surfaces 14, 15. In the example shown, the bearing surfaces 10, 34 are divided into two portions 55, 56 which are at an angle to one another with an intervening rounded surface 57, as a result of which a satisfactory bearing surface is obtained for the locking members 16, 22. As a result of this taking up of the load, the holder element 1 is exposed, in its material, mainly to tensile stresses which involve little risk of breakage for the majority of steel qualities which occur.

As a result of suitably selected toughness in the material of the holder element 1, a certain bending and other deformation is permitted without risk of breakage under relatively heavy loads. With low or normal loading, the loading is transmitted to the holder element 1 primarily via the upper locking member 16 which transmits to its bearing surface 10 both a downwardly directed and an outwardly directed component of force from the wall surface 2. An increased loading is successively transmitted to the lower locking member 22 as a result of the fact that the upper locking member 16 tends to move ever more outwards, leading either to deformation in the stop surface 10 or to the locking member 16 sliding upwards somewhat as a result of the inclination of the stop surface. This thus leads to a successively increasing pressure from the lower locking member 22 against the stop surface 34. This distribution of the load leads to an every more symmetrical loading both of the holder element 1 and of the coupling member and so results in an exceptional loading tolerance in the device according to the invention.

Dismantling of the work stand takes place in a very reliable manner as a result of the fact that the brackets 4 are held without help in their hooked up state during the time when the locking device 21 is released by angular turning of the pins 22 and withdrawal, after which the brackets can be lifted off after they have been freed from their working platforms 36. The lifting off takes place very simply by lifting upwards and outwards from the wall surface 2.

The reversibility obtained by the symmetrical shape of the holder element 1 is particularly advantageous for those applications, for example in the shipbuilding industry, where large sections of vessels are prefabricated elsewhere using work stands and are moved for a final mounting when the section in question is turned through 180°. In this case, the holding element 1 can remain in place and serve as a securing means for the scaffold even in its reversed state with the former downward facing portion 6 turned upwards, forming a hooking member while the portion 5, previously facing upwards, is turned downwards for cooperation with the locking device 21.

Figure 7:
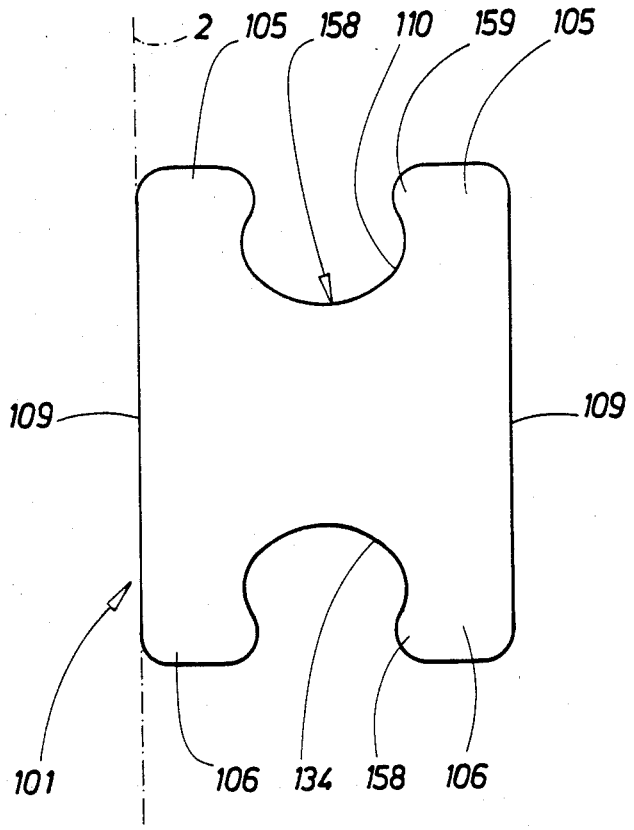

In FIG. 7, a side view is shown of an advantageous alternative form of embodiment of the holder element, the reference numerals in this figure being increased by a hundred in relation to corresponding parts in connection with earlier figures. In this case, too, the holder element 101 is a plate-shaped element which is cut out of a plate or the like for example. Like the holder element described below, this holder element 101 is symmetrical and can be turned about a central imaginary horizontal axis of symmetry and in addition is symmetrical and can be turned about a vertical central axis of symmetry. Thus the holder element 101 is made with two plane side edges which form the securing surface 109 of the holder element. It is thus immaterial which of the two securing surfaces 109 is used and as a result, on the one hand the advantage is obtained that a large securing surface and hence maximum anchoring in the wall surface is obtained in relation to the size of the holder element and on the other hand simplicity in handling as a result of the fact that there is the minimum risk of the holder element being mounted wrongly. Thus the holder element 101 comprises four corner portions 105, 106 which thus correspond to the hooking up portions previously mentioned and two bearing or stop surfaces 110, 134 which are formed by two recesses 158 facing away from one another. In order to obtain extra security against accidental unhooking, the two recesses 158 are made somewhat narrower in the outward direction as a result of the fact that each corner portion 105, 106 comprises a small rounded projection 159. Furthermore, the bearing surfaces 110, 134 have such a shape that the upper supporting surfaces 18, 19 of the coupling device can be held pressed against the associated wall surface 2 without clearance. This is brought about as a result of the fact that the bearing surfaces 110, 134 have a certain inclination, which faces the wall surface 2 so that the locking member 16 is held in the recess without sliding in the recess to the maximum in the direction towards the right in the figure, that is to say in the direction away from the wall surface 2.

The invention is not restricted to the examples of embodiment described above and shown in the drawings but may be varied within the scope of the following Patent Claims. The locking device 21 can be locked otherwise than by the combination of projections and recesses and may instead be made with a spring mechanism which can be moved downwards. Instead of a pin, a spring-loaded detent may be brought into cooperation with a portion of the holder element. The two upper supporting surfaces 18, 19 may be omitted or be replaced by a single broad coherent supporting surface. The hookable member 16 may be replaced by another member which connects the two elements 11, 12. For example, the two elements may be made in a single unit bent into U-shape which is suspended in reversed state, in which case no separate bar element is required.

The release of the locking position can also be taken care of in a completely different manner than by withdrawing the one locking member 34. For example, this can be done as a result of the fact that the gap 13 in the coupling device is so designed that the locking members 16, 22 can be brought out of engagement with the bearing surfaces 10,34 of the holder element 1 by angular turning of the coupling device about an axis parallel to the line of symmetry of the holder element. Alternatively, the one element 11 or 12 of the coupling device 3 can be made detachable in which case the release is brought about by lateral displacement of the coupling device 3 in relation to the holder member. In certain cases, no lower supporting surface is needed, for example with a scaffold between two opposite walls, where each bracket comprises a coupling device at each end and extends between two holder elements, one on each wall. The invention may also be applied to work stands which are suspended in a roof where the holder element is turned upwards with its supporting surface 9 and the bracket is replaced, for example, by a downwardly directed arm.

For the sake of clarity, it should be explained that the hooking-up portions 5, 6 and the bearing surfaces 10, 34 have been given the same names both at the top and at the bottom because of the reversibility of the holder element 1. More specifically, the downward facing hooking-up portion 6 and the associated bearing surface 34 form a stop member and a stop surface respectively, which are included in the locking device 21.

I claim:

1. A device for supporting an object detachably at a wall surface, comprising: a supporting member for the object; a coupling device to be fitted to the supporting member; said supporting member having a supporting surface to rest against the wall surface below the coupling device; a holder element having a plate-shaped body with at least one attachment surface to be fixed to the wall surface, and having at least two hooking-up portions which are directed away from one another, one directed upwardly and the other downwardly, each hooking-up portion having a bearing surface partially turned towards the wall surface; said coupling device comprising: two portions provided with guide surfaces facing one another and forming therebetween a gap for receiving said holder element, and also a first, upper locking member positioned in the gap and adapted to be hooked up to the hooking-up portion which is directed upwardly; the coupling device further comprising a locking device movable between a locking position and a releasing position and vice versa, said locking device in the locking position ensuring that the coupling device is held firmly hooked to the holder element, and in the releasing position, allowing the coupling device to be unhooked from the holder element; the holder element being substantially symmetrical relative to at least a central axis extending symmetrically from said wall surface; said locking device also having a second, lower locking member cooperating with the downwardly directed hooking-up portion in the locking position of the locking device to prevent the coupling device from being unhooked from said holder element, said coupling device having at least one, upper supporting surface for bearing against said wall surface, said bearing surfaces of the hooking-up portions having an inclined or curved portion allowing the bearing point between the upper locking member and the bearing surface cooperating therewith to be chosen such that support of the upper support surface against the wall surface is assured.

2. A device as claimed in claim 1, comprising two upper supporting surfaces positioned at the same distance from the upper locking member.

3. A device as claimed in claim 1, wherein said two portions of the coupling device consist of two U-shaped sections having arms directed away from one another and mutually connected by said upper locking member.

4. A device as claimed in claim 3, wherein at least one locking member is a pin having at one end a handle by means of which the pin can be moved between two angular positions, one angular position forming the locking position, and the other angular position forming said releasing portion.

5. A device as claimed in claim 2, wherein the holder element is symmetrical in mirror image in relation to two central axes of symmetry crossing one another, as a result of which the holder element comprises four corner portions which form said hooking-up portions and two recesses facing away from one another, and comprising said bearing surface and two supporting surfaces facing away from one another, whereby said holder element can be turned as desired with either of the two recesses facing upwards and with either of the two securing surfaces fixed to the wall surface.

* * * * *